US006268689B1

(12) United States Patent
Joung

(10) Patent No.: US 6,268,689 B1
(45) Date of Patent: Jul. 31, 2001

(54) CONVERGENCE ASSEMBLY INCLUDING A CORRECTION RING FOR A COLOR CATHODE RAY TUBE

(75) Inventor: Jang-Jin Joung, Suwon (KR)

(73) Assignee: Samsung SDI Co., Ltd., Kyungki-Do (KR)

( * ) Notice: Subject to any disclaimer, the term of this patent is extended or adjusted under 35 U.S.C. 154(b) by 0 days.

(21) Appl. No.: 09/210,376

(22) Filed: Dec. 14, 1998

(30) Foreign Application Priority Data

May 6, 1998 (KR) ..... 98-16127

(51) Int. Cl.[7] ..... H01J 29/54; H01F 1/00

(52) U.S. Cl. ..... 313/440; 335/210; 335/212; 313/412

(58) Field of Search ..... 335/210, 211, 335/212, 213, 214, 440; 313/421, 427, 440, 431, 412

(56) References Cited

U.S. PATENT DOCUMENTS 3,808,570 * 4/1974 Thompson et al. ..... 335/212
4,091,347 * 5/1978 Barbin ..... 335/212
4,310,819 * 1/1982 Morita et al. ..... 335/212
4,670,726 * 6/1987 Ogata et al. ..... 335/212
5,227,753 * 7/1993 Hirai et al. ..... 335/212
5,289,149 * 2/1994 Nishita et al. ..... 335/212
5,708,323 * 1/1998 Okamoto ..... 313/431
5,757,122 * 5/1998 Kim ..... 313/440
5,955,830 * 9/1999 Uyama ..... 313/412

* cited by examiner

*Primary Examiner*—Ashok Patel
*Assistant Examiner*—Matthew J. Gerike
(74) *Attorney, Agent, or Firm*—Leydig, Voit & Mayer, Ltd.

(57) ABSTRACT

A convergence magnet assembly for a cathode ray tube (CRT) includes a convergence magnet assembly having at least a one pair of magnet rings having magnetized portions at angular intervals and installed on a neck portion of a CRT for static convergence of three electron beams in an in-line arrangement; and a correction ring with an odd number of poles located at one side of the neck, adjacent an electron beam at one side of the in-line three electron beams, increasing a shift in the electron beam position caused by the pair of magnet rings.

8 Claims, 4 Drawing Sheets

CONVERGENCE ASSEMBLY INCLUDING A CORRECTION RING FOR A COLOR CATHODE RAY TUBE

BACKGROUND OF THE INVENTION

1. Field of the Invention

The present invention relates to an in-line type color cathode ray tube (CRT), and more particularly, to a convergence magnet assembly installed in the neck of a CRT for adjusting the static convergence of an electron beam of the CRT.

2. Description of the Related Art

Generally, in a color CRT having in-line type electron guns, the axes of three electron guns are arranged in the same plane including the tubular axis of the CRT such that the paths of two outside electron beams emanating from the electron guns located on both sides of the central electron gun will be symmetrical with respect to the path of the electron beam emanating from the central electron gun. Thus, it is advantageous to construct the electron gun assembly of such a CRT to cause the electron beams emanating from the respective guns but not deflected by deflecting means to converge at the center of a fluorescent screen located in front to the electron gun assembly so as to produce clean pictures.

However, it is difficult to cause picture tubes to satisfy such ideal conditions due to manufacturing errors in components parts of the tube or permissible dimensional allowances of the component parts.

For this reason, the color CRTs generally have slight variations in the path characteristics of the electron beams. It is known that the paths of electron beams are modified to compensate for such variations in electron beam path characteristics. The paths of the electron beams can be modified by an adjustable magnetic field, which has been used to provide a required color purity adjustment as well as static convergence adjustment.

That is, as shown in FIG. 1, the color purity has been adjusted by relatively rotating two annular shaped two-pole permanent magnets 11 and 11' mounted parallel to each other on a neck portion 101 of a CRT 100, surrounding the paths of the electron beams. Also, a static convergence adjustment has been accomplished by providing two annular shaped four-pole permanent magnets 12 and 12' and two annular shaped six-pole permanent magnets 13 and 13' mounted parallel to each other on the neck portion 101 of the CRT surrounding the paths of the electron beams. When the magnet assembly 10 is aligned, the intensity of the magnetic field of the magnet assembly is maximized. On the other hand, when two permanent magnets are rotated relative to each other over a predetermined angle, e.g., 180°, 90° or 60°, the intensity of the magnetic field of the magnet assembly is minimized.

Where the CRT is ideally manufactured according to a design rule, a static convergence error is not generated or few errors are generated. Thus, it is not necessary to provide the magnet assembly. The static convergence is dislocated due to the minimum magnetic field of the magnet assembly mounted on the neck portion of the CRT. Accordingly, the convergence magnet assembly should be manufactured such that shifting of an electron beam is minimized. In the magnet assembly having a minimum beam shift, as shown in FIG. 2, if the distance OCV between the outer two electron beams, among three electron beams in an in-line arrangement, and the distance CCV from the midpoint of the distance OCV and the central beam deviate from the range A of the minimum shift amount, it is difficult to adjust static convergence.

SUMMARY OF THE INVENTION

To solve the above problems, it is an objective of the present invention to provide a convergence magnet assembly for a cathode ray tube (CRT), which can converge the minimum adjustable amount to zero, by extending the range of adjustment of static convergence of an electron beam.

It is another objective of the present invention to provide a convergence magnet assembly for a CRT, which can improve picture resolution by improving characteristics corresponding to adjustment of purity and convergence.

To achieve the first objective, there is provided a convergence magnet assembly for a cathode ray tube (CRT) comprising:

at least one pair of magnet rings having magnetized portions at predetermined angular intervals and installed at a neck portion of the CRT, for static-convergence of three electron beams in an in-line arrangement; and correction means having a correction ring magnetized by an odd number of at least three poles on at least one side adjacent to electron beams at either side among three electron beams to intentionally increase the electron beam shift amount by the pair of magnet rings.

According to another aspect of the present invention, there is provided a convergence magnet assembly according to claim 6, wherein the intensity of the magnetic field caused by the central pole among three poles magnetized on the correction ring is stronger than that caused by the pole disposed at either side thereof.

DESCRIPTION OF THE PREFERRED EMBODIMENTS

Figure 1:
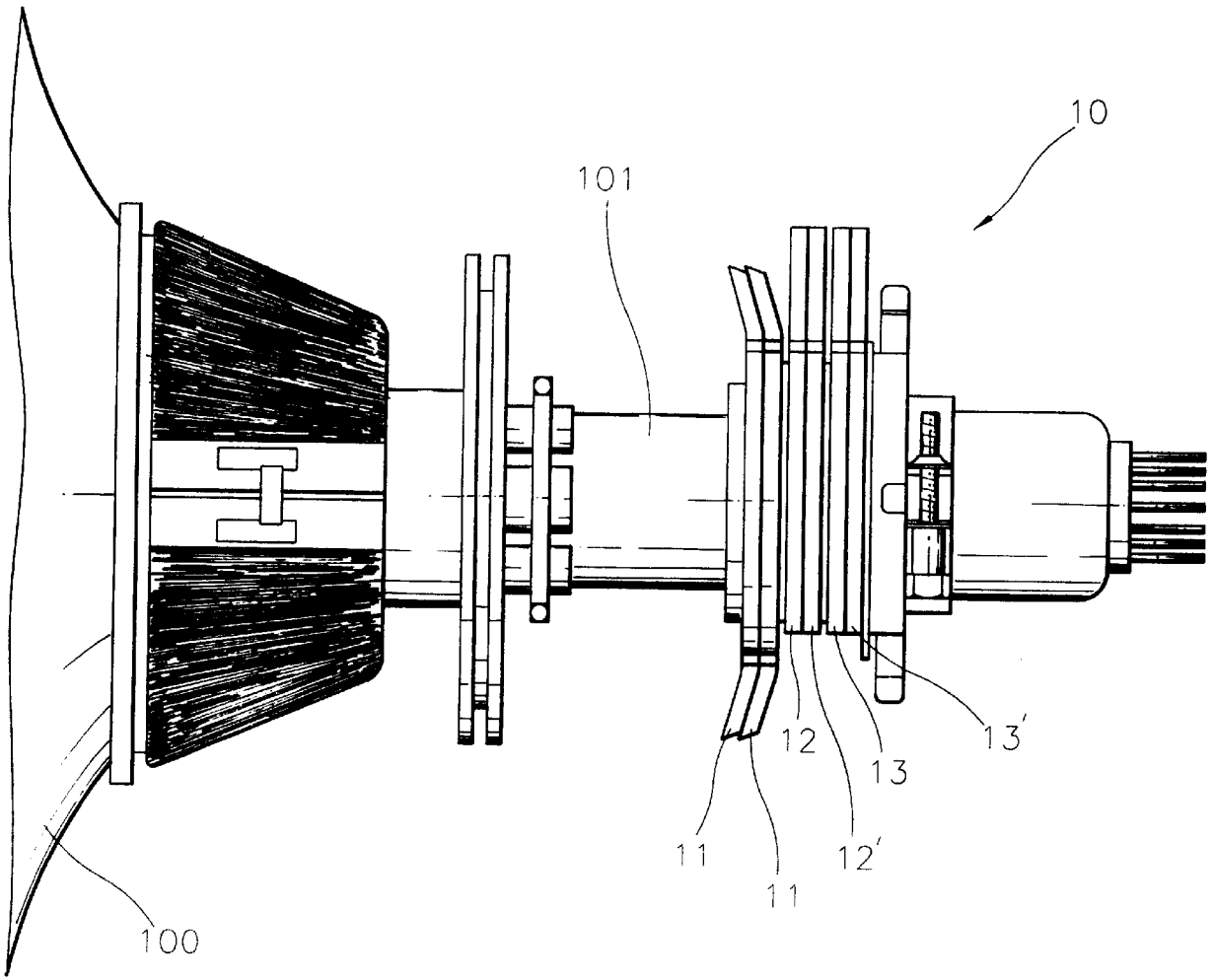
FIG. 1(PRIOR ART)
FIG. 1 is a side view illustrating a cathode ray tube on which a conventional magnet assembly is installed.
Figure 2:
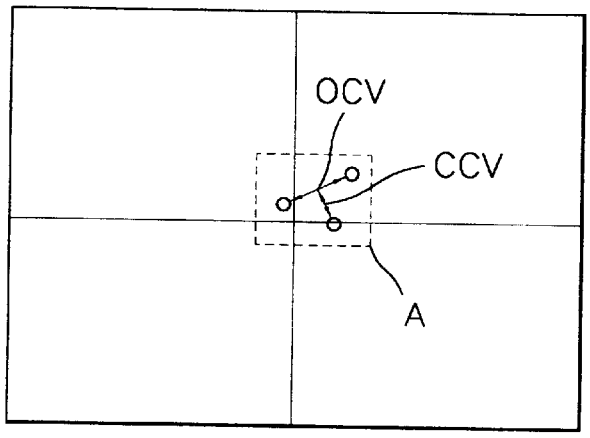
FIG. 2(PRIOR ART)
FIG. 2 schematically shows incorrect convergence of three electron beams.
Figure 3:
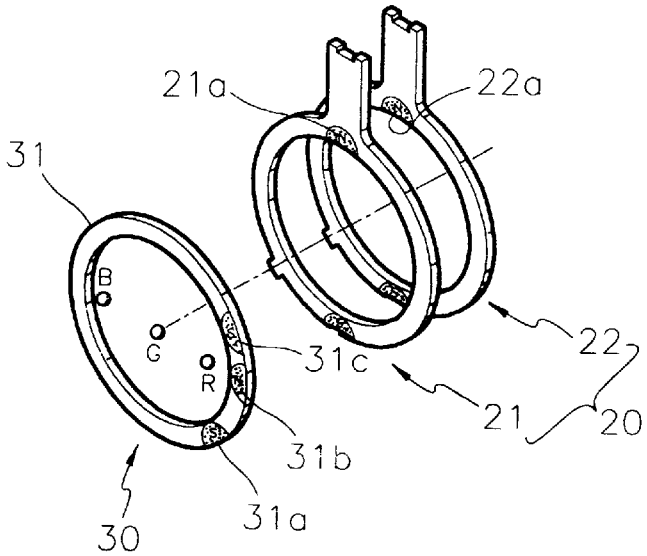
FIG. 3 is an exploded perspective view of a convergence magnet assembly for a cathode ray tube according to the present invention.

FIG. 3 shows a magnet assembly according to a preferred embodiment of the present invention, which is mounted on the neck portion of a color CRT having in-line type electron guns, and which adjusts the path of an electron beam of the CRT.

As shown in FIG. 3, a magnet assembly 20 includes at least one pair of magnet rings 21 and 22 spaced a predetermined distance apart from each other and a correction unit 30 for deviating the static convergence state to over the minimum shift amount of an electron beam by the magnet rings 21 and 22. The magnet rings 21 and 22 have a plurality of magnetized portions 21*a* and 22*a*.

The magnet rings 21 and 22 are made of a ferrite core, barium ferrite or alnico which is an alloy of aluminum, nickel and cobalt. The magnetized portions 21*a* and 22*a* are formed to have N and S poles alternately arranged. The magnet rings 21 and 22 may have two poles, four poles or six poles of magnetized portions.

Figure 4:
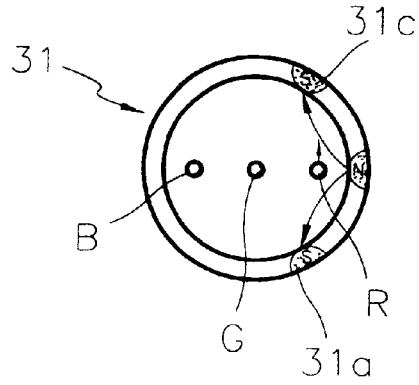
FIG. 4 is a front view of a first correction ring of a correction unit shown in FIG. 3.
Figure 5:
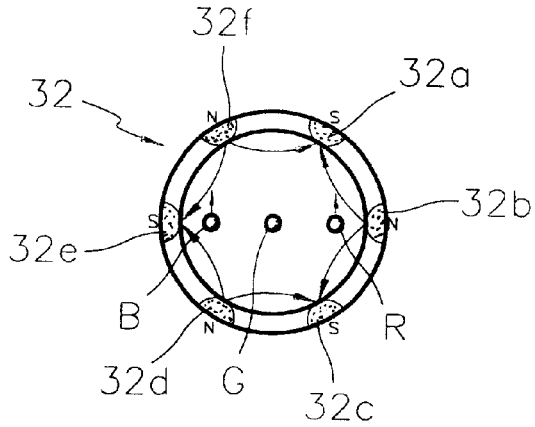
FIG. 5 is a front view of a second correction ring of a correction unit shown in FIG. 3.

The correction unit 30 includes a first correction ring 31 magnetized to have at least three poles 31*a*, 31*b* and 31*c* for shifting the outer electron beams among three electron beams in an in-line arrangement, as shown in FIGS. 4 and 5. The three poles 31*a*, 31*b* and 31*c* are positioned adjacent to R or B electron beams, among three electron beams for exciting red, green and blue phosphors, that is, R, G and B electron beams, so that the distance between the R and B electron beams, represented by "OCV", and the distance between the centers of the R and B electron beams and the G electron beam are adjusted by shifting the R or B electron beams. Here, the central pole among the three poles 31*a*, 31*b* and 31*c* of the first correction ring 31 is preferably positioned along a horizontal axis of the in-line electron beams. The three poles 31*a*, 31*b* and 31*c* of the first correction ring 31 are magnetized such that the magnetic intensity of the central pole is different from that of the pole at either side thereof, that is, the magnetic intensity of the central pole is stronger than that of the pole at either side thereof. Although it has been described above that the first correction ring 31 has three poles by way of an example, the first correction ring may be magnetized to have an odd number of poles, and at least three poles.

Also, as shown in FIG. 5, the correction unit may further include a second correction ring 32 having six poles 32*a* through 32*f* magnetized thereon, for shifting the B and R electron beams simultaneously. The first and second correction rings 31 and 32 can be installed not only in the neck portion but also at any position of the funnel so as to surround the path of the electron beams emanating from the electron guns.

Figure 6:
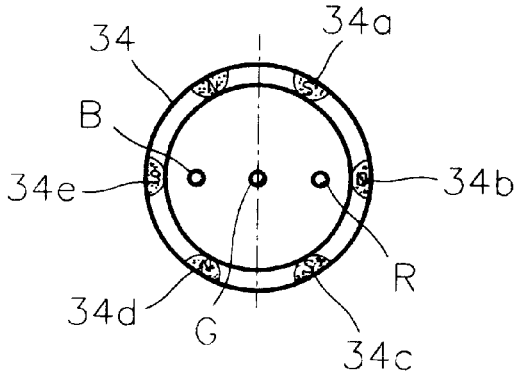
FIG. 6 is a front view of a single six-pole correction ring of another example of the correction unit.

Alternatively, as shown in FIG. 6, the correction unit may include a single correction ring 34 having six poles 34*a* through 34*f*. In this case, the intensity of the magnetic field caused by three poles 34*d*, 34*e* and 34*f* near the path of the B electron beam is different from that caused by three poles 34*a* , 34*b* and 34*c* near the path of the R electron beam.

The static convergence by the magnet assembly according to the present invention is adjusted as follows.

The first correction ring 31 of the correction unit extends the correction margin within the range from the minimum correction level to the maximum correction level. Thus, the pair of magnet rings 21 and 22 are rotated relatively over a predetermined angle to vary the magnetic flux densities, thereby perfecting correction of the shift of the electron beams, which will now be described in more detail.

When the pair of magnet rings 21 and 22 are relatively rotated such that the opposite poles of the respective magnetized portions 21*a* and 22*a* close in on each other to minimize the intensity of the combined magnetic field, the combined magnetic field is not completely offset but is attenuated in its average magnetic flux density and peak value by a predetermined ratio. Thus, when the intensity of the combined magnetic field is a minimum, it is difficult to adjust the static convergence by relatively rotating the pair of magnet rings over a predetermined angle within the range of the minimum shift amount of the electron beam, i.e., 0.1~0.3 mm. To solve the problem, the shift of electron beams is made to deviate to an extent exceeding the minimum shift amount of a beam due to the magnetic field of three poles 31*a*, 31*b* and 31*c* on the first correction ring 31. In this case, the static convergence of the electron beam deviated over the minimum beam shift amount of the magnet rings 21 and 22 can be adjusted by relatively rotating the pair of magnet rings 21 and 22, and the adjustable margin can be increased.

According to experiments by the inventor of the present invention, the shift amounts of the electron beams in an in-line arrangement were found to be adjusted as shown in Tables 1-1 and 1-2.

TABLE 1-1

| | Position of magnetized portion of first correction ring | Axis | Distance between R-G beams (mm) | Distance between B-G beams (mm) | Distance between R-B beams (mm) | Remark |
|---|---|---|---|---|---|---|
| A | | X | 0.94 | −0.18 | 1.13 | Standard |
| | | | 0.44 | −0.78 | 1.22 | |
| B | B-beam | X | 0.74 | 0.58 | 0.17 | yellow |
| | | Y | 1.02 | 10.3 | −0.01 | pixel/ |
| | | X-axis shift (mm) | 0.2 | 1.34 | 0.96 | B-beam rising |
| | | Y-axis shift (mm) | 0.58 | 1.8 | 1.21 | |
| | R-beam | X | 1.06 | 0.44 | 0.62 | red pixel/ |
| | | Y | 2.04 | 0.44 | 0.62 | R-beam |
| | | X-axis shift (mm) | 0.12 | 0.62 | 0.51 | rising |
| | | Y-axis shift (mm) | 1.6 | 0.82 | 0.77 | |
| | R-beam | X | 1.16 | 0.25 | 0.91 | blue |
| | | Y | 0.53 | 0.59 | −0.06 | pixel/ |
| | | X-axis shift | 0.22 | 0.43 | −0.22 | R-beam falling |

TABLE 1-1-continued

| Position of magnetized portion of first correction ring | Axis | Distance between R-G beams (mm) | Distance between B-G beams (mm) | Distance between R-B beams (mm) | Remark |
|---|---|---|---|---|---|
| | (mm) | | | | |
| | Y-axis shift (mm) | 0.09 | 1.37 | 1.16 | |

TABLE 1-2

| | Position of magnetized portion of first correction ring | Axis | Distance between R-G beams (mm) | Distance between B-G beams (mm) | Distance between R-B beams (mm) | Remark |
|---|---|---|---|---|---|---|
| A | | X | 1.22 | 0.65 | 1.86 | Standard |
| | | | −0.09 | 0.05 | −0.14 | |
| B | B-beam | X | 0.84 | −0.59 | 1.44 | yellow |
| | | Y | 0.25 | 2.0 | −1.75 | pixel/ |
| | | X-axis shift | 0.38 | 1.24 | 0.24 | B-beam rising |
| | | Y-axis shift (mm) | 0.34 | 1.95 | 1.61 | |
| | R-beam | X | 1.06 | −0.38 | 1.44 | red pixel/ |
| | | Y | 1.50 | 0.98 | 0.51 | R-beam |
| | | X-axis shift (mm) | 0.16 | 1.03 | 0.42 | rising |
| | | Y-axis shift (mm) | 1.59 | 0.93 | 0.65 | |
| | R-beam | X | 1.2 | −0.81 | 2.0 | blue |
| | | Y | −0.39 | 1.51 | −1.91 | pixel/ |
| | | X-axis shift (mm) | 0.02 | 1.46 | 0.14 | R-beam falling |
| | | Y-axis shift (mm) | 0.3 | 1.46 | 1.99 | |

In Table 1-1, A represents the shift of an electron beam of a conventional 15-inch CRT, and B represent the shift of an electron beam when a first correction ring having three magnetized poles and a second correction ring having six magnetized poles are installed on the 15-inch CRT. In Table 1-2, A represents the shift of an electron beam of a conventional 17-inch CRT, and B represent the shift of an electron beam when a first correction ring having three magnetized poles and a second correction ring having six magnetized poles are installed on the 17-inch CRT.

As is evident from Tables 1-1 and 1-2, since the range of the minimum electron beam shift by the magnet rings 21 and 22 exceeds 0.2 mm, perfect adjustment of the electron beam shift is possible with the magnet rings 21 and 22. In particular, since the distance between R and B electron beams, i.e., OCV, is greater than 1 mm, static convergence for the deviated electron beams is perfectly adjusted.

Figure 7:
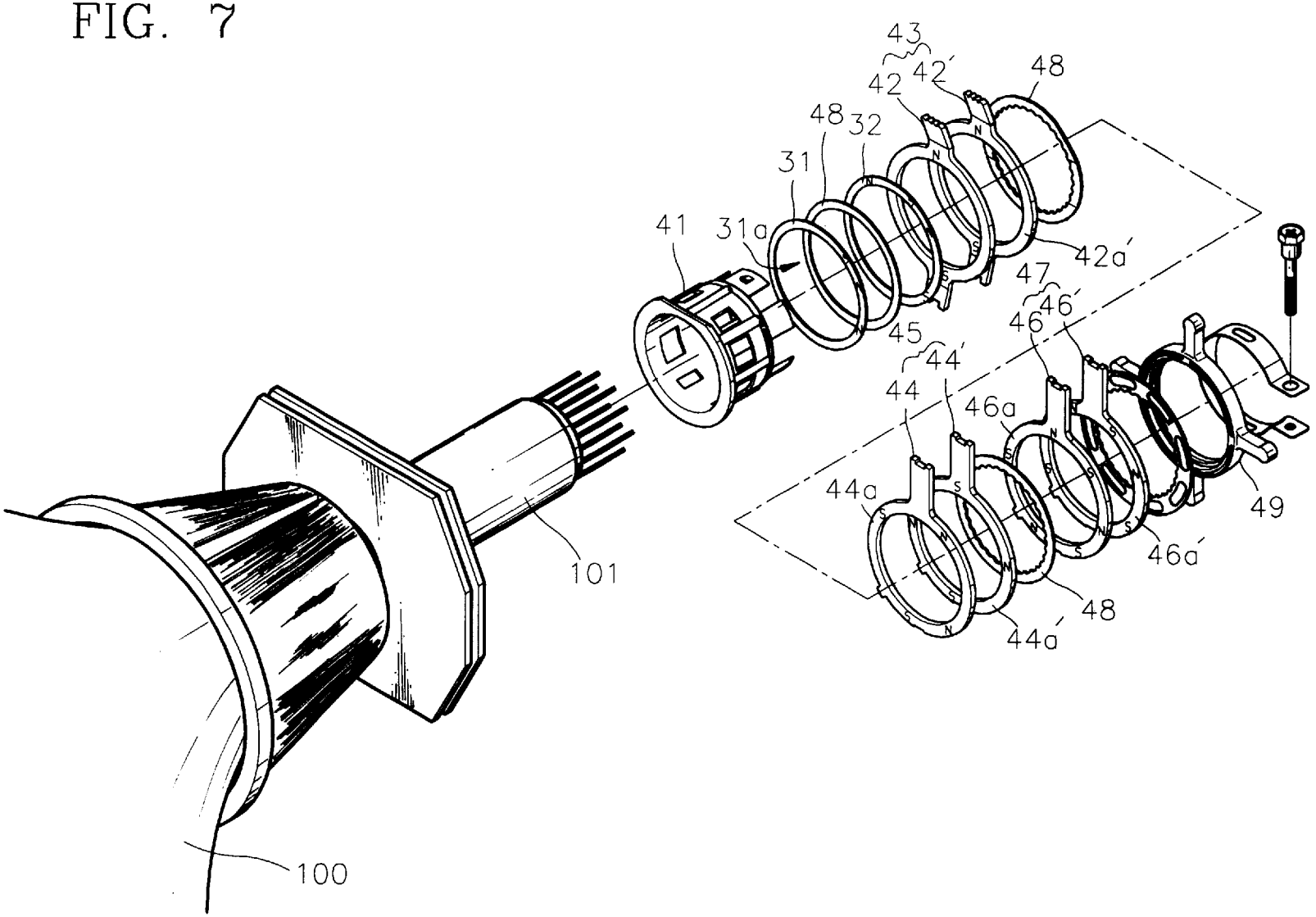
FIG. 7 is an exploded perspective view illustrating the state in which a convergence magnet assembly for a cathode ray tube according to the present invention on installed in a neck portion of the CRT.

FIG. 7 shows a convergence magnet assembly according to another embodiment of the present invention.

As shown in FIG. 7, a housing 41 is connected to a neck portion 101 of a CRT 100. A purity magnet assembly 43 is rotatably installed in the housing 41 and comprises a pair of two-pole magnet rings 42, and 42' each having magnetized portions 42*a* and 42*a'* with two poles (N and S poles).

Also, the housing 41 is provided with a first static convergence assembly 45 comprising of a pair of four-pole magnet rings 44 and 44' each having magnetized portions 44*a* and 44*a'* with four poles (N, S, N and S poles), and a second convergence assembly 47 comprising a pair of six-pole magnet rings 46, and 46' each having magnetized portions 46*a* and 46*a'* with six poles (N, S, N, S, N and S poles).

A spacer 48 made of a non-magnetic substance is installed in the housing 41 and interposed between the two-, four- and six-pole magnet rings 42 & 42', 44 and 44', and 46 and 46', and a fixation element 49 is combined with the housing 41 to prevent the respective magnet rings from deviating from the housing 41.

A correction means for deviating the static convergence state to an extent exceeding the minimum amount of shift of an electron beam, caused by the two-, four- and six-pole magnet rings 42 and 42', 44, and 44' and 46 and 46', is installed in the housing 41. The correction means includes at least one of the first correction ring 31, the second correction ring 32 and the six-pole correction ring 34, as described above.

Magnetization of the first correction ring 31 are not limited to three poles is are applicable to any structure in which the R or B beam can be shifted by at least the minimum beam shift amount of the magnet rings, that is, the first correction ring 31 is preferably magnetized in an odd number, at least three, poles. Also, the first and second correction rings 31 and 32 can be installed not only in the housing but also at any place along the path of the electron beams emitted from the electron guns.

Also, in the above-described embodiment, the spacer interposed between the purity magnet assembly 43 and the first and second static convergence assemblies 45 and 47 can be replaced with at least one of the first and second correction rings 31 and 32 and the six-pole correction ring 34.

The operation of the convergence magnet assembly as constructed above according to the present invention will now be described.

The electron beam emitted from in-line electron guns is deviated by the first correction ring 32 of the correction unit 30 such that the R or B electron beam is deviated more than the minimum electron beam shift amount produced by the four- or six-pole magnet rings.

In other words, as shown in FIG. 7, even in a state in which the color purity and static convergence are not adjusted by the purity magnet assembly 43 and the first and second static magnet assembly 45 and 47, the magnetic field is applied to the R or B electron beam emitted from the electron gun due to the first and second correction rings 31 and 32 or the six-pole correction ring 34, thereby shifting the beams by an amount exceeding the minimum electron beam shift amount.

In such a state, the static convergence is adjusted by shifting the B and R electron beams positioned at both sides of the G electron beam in opposite directions with the four-pole magnet rings 44 and 44' of the first static magnet assembly 45, and shifting the B and R electron beams in the same direction with the six-pole magnet rings 46 and 46' of the second static magnet assembly 47.

At this time, since the B and R electron beams are deviated more than the minimum electron beam shift amount by the four-pole magnet rings 44 and 44' or the six-pole magnet rings 46 and 46', the static convergence can be adjusted to zero.

For example, if the intensities of the magnetic fields of the respective magnetized portions of the four-pole magnet rings 44 and 44' or the six-pole magnet rings 46 and 46' are the same at about 100 gauss, the minimum electron beam shift amount produced by adjusting the respective magnet rings is 0.7 mm. In this case, the distance between the B and R electron beams is made 1.5 mm and the distance between the center of the distance from B to R electron beams and the G electron beam is made 1 mm, using the first correction ring 31, so that the minimum adjustable electron beam shift amount can be reduced to zero.

The pair of two-pole magnet rings 42 and 42' shift the B, G and R electron beams in the same direction according to Flemming is left-hand rule the Lorentz force, thereby adjusting the color purity.

As described above, in the convergence magnet assembly for a CRT according to the present invention, the OCV and CCV of the electron beams are deviated to an extent exceeding the minimum electron beam shift with two-, four- or six-pole magnet rings, thereby converging the static convergence to zero. Therefore, static convergence characteristics and color purity can be enhanced.

The convergence magnet assembly for a CRT according to the present invention is not limited to the illustrative embodiments and many changes and modifications can be effected by one skilled in the art within the spirit and scope of the invention.

What is claimed is:

1. A convergence magnet assembly for a cathode ray tube (CRT) comprising:

a housing fixable on a neck of a CRT generating three in-line electron beams in the neck of the CRT;

a purity magnet assembly installed on the housing and comprising a pair of two-pole magnet rings having magnetized portions at respective angular intervals producing magnetic fields of equal intensities;

a static convergence magnet assembly comprising at least one pair of magnet rings having four or six magnetic poles producing magnetic fields of equal intensities;

a non-magnetic spacer interposed between the purity magnet assembly and the static convergence magnet assembly; and at least one correction means installed on the housing and including a first correction ring having an odd number, greater than one, of magnetic poles, increasing a shift in position of a first electron beam, of the three in-line electron beams, beyond a shift produced bv the static convergence magnet assembly.

2. The convergence magnet assembly according to claim 1, wherein the correction means further includes a second correction ring installed coaxially with the first correction ring and having six poles at respective angular intervals.

3. The convergence magnet assembly according to claim 2, wherein the six magnetic poles produce a magnetic field intensity near a central one of the three in-line electron beams that is different from the magnetic field intensity produced near the two of the electron beams of the three in-line electron beams, at opposite sides of the central electron beam of the three in-line electron beams.

4. The convergence magnet assembly according to claim 1, wherein the first correction ring has two outer poles and a central pole between the outer poles and the central pole is coplanar with the three in-line electron beams.

5. The convergence magnet assembly according to claim 4, wherein the central pole produces a magnetic field different from the magnetic field produced by the outer poles.

6. The convergence magnet assembly according to claim 5, wherein the central pole produces a magnetic field stronger than the magnetic field produced by the outer poles.

7. The convergence magnet assembly according to claim 4, wherein the central pole produces a magnetic field stronger than the magnetic field produced by the outer poles.

8. The convergence magnet assembly according to claim 1, wherein the first correction ring produces magnetic flux densities at a central one of the three in-line electron beams different from magnetic flux densities produced by the first correction ring at the two electron beams, of the three in-line electron beams, on opposite sides of the central electron beam.

* * * * *